US005823929A

United States Patent [19]

Kavolius et al.

[11] Patent Number: 5,823,929

[45] Date of Patent: Oct. 20, 1998

[54] RECONDITIONING PRIMARY CHARGE ROLLERS FOR ELECTROSTATOGRAPHIC IMAGING MACHINES

[75] Inventors: Vytas A. Kavolius, Charlottesville; Joseph E. White, Mt. Crawford; Bradford G. Buttner, Charlotesville, all of Va.

[73] Assignee: Genicom Corporation, Chantilly, Va.

[21] Appl. No.: 771,204

[22] Filed: Dec. 20, 1996

[51] Int. Cl.[6] ..... B25F 5/02

[52] U.S. Cl. ..... 492/53; 492/49; 492/56; 29/895.1; 29/895.32; 428/367; 428/906

[58] Field of Search ..... 427/58, 122, 140, 427/180; 355/132; 492/53, 56, 49; 29/895.1, 895.32, 895.3; 428/367, 906

[56] References Cited

U.S. PATENT DOCUMENTS

| | | | |
|---|---|---|---|
| 162,514 | 4/1875 | Allen . | |
| 2,622,038 | 12/1952 | Charlesworth et al. . | |
| 3,257,945 | 6/1966 | Smith, Jr. . | |
| 3,846,223 | 11/1974 | Lederman et al. . | |
| 4,505,573 | 3/1985 | Brewington et al. . | |
| 4,681,712 | 7/1987 | Sakakibara et al. . | |
| 5,057,370 | 10/1991 | Krieg et al. . | |
| 5,150,165 | 9/1992 | Asai | 355/274 |
| 5,363,176 | 11/1994 | Ishihara et al. | 355/219 |
| 5,418,106 | 5/1995 | Snyder, Jr. et al. | 430/130 |
| 5,440,374 | 8/1995 | Kisu | 355/219 |
| 5,471,285 | 11/1995 | Nagase et al. | 355/219 |
| 5,543,899 | 8/1996 | Inami et al. | 355/219 |
| 5,619,311 | 4/1997 | Kurokawa et al. | 399/176 |

FOREIGN PATENT DOCUMENTS 0708382 4/1996 European Pat. Off. .

OTHER PUBLICATIONS

Carbon Black for Conductive Plastics, Degussa Technical Bulletin No. 69 (1986).

Degussa Pigment Blacks for Conductive Coatings, Tehcnial Bulletin Pigments, No. 65 (1990).

CABOT Carbon Blacks for Specialty Applications, North American Technical Report S–136 (1980).

Foster, John K. et al, "Effects of Carbon Black Properties on Conductive Coatings", Congresse Internacional de Tintes, pp. 902–911 (1991).

Sommers, David J., Carbon Black for Electrically Conductive Plastics, Technical report S–39 (1985).

*Primary Examiner*—Shrive Beck
*Assistant Examiner*—Michael Barr
*Attorney, Agent, or Firm*—Nixon & Vanderhye P.C.

[57] ABSTRACT

Used, spent or physically degraded primary charge rollers (PCR's) may be rejuvenated to an extent that is operationally comparable to (or exceeds) the print quality and service life of an OEM-supplied PCR. The used PCR is treated so as to apply an overcoating of a dispersion which includes an electrically conductive particulate material, such as graphite or carbon black, and a polymeric binder (e.g., polyurethane latex). The electrically conductive material imparts the necessary electrical properties to the PCR for purposes of "rejuvenation", while the presence of the polymeric binder serves to impart long-term service life to the PCR and also permits the use of less electrically conductive material.

2 Claims, No Drawings

RECONDITIONING PRIMARY CHARGE ROLLERS FOR ELECTROSTATOGRAPHIC IMAGING MACHINES

CROSS-REFERENCE TO RELATED APPLICATIONS

This application may be deemed to be related to copending, commonly owned U.S. patent application Ser. No. 08/770,772 filed even date herewith entitled "Reconditioning Charge Blades for Electrostatographic Cartridges", the entire content of which is expressly incorporated hereinto by reference.

FIELD OF INVENTION

The present invention generally relates to the field of electrostatographic imaging machines. More specifically, the present invention relates to primary charge rollers (PCR's) employed in electrostatographic imaging machines. In preferred embodiments, the PCR's of this invention are reconditioned so as to include an overcoating of particulate graphite or carbon thereon so as to "rejuvenate" the PCR's to an extent that is comparable to those supplied by original equipment manufacturers (OEM's).

BACKGROUND AND SUMMARY OF THE INVENTION

Primary charge rollers (PCR's) are conventionally used in electrostatographic imaging machines (e.g., photocopiers, laser printers and the like) for the purpose of charging/discharging photoconductive charge members (colloquially known in this art as "photoconductors", or more specifically, organic photoconductors (OPC's)). The most simplistic construction of conventional PCR's includes a metallic, low electrical resistance axle surrounded by a cylindrically-shaped conductive foam (typically, an open-cell polyurethane foam) roller which is usually filled with carbon or graphite to achieve the desired electrical properties. The conductive or semi-conductive foam is then coated with a thin-film polymer, approximately 0.002 inch thick.

During normal use, however, the thin film polymer coating's electrical and physical properties change over time to an extent that its resistance to electrical current flow gradually increases in direct proportion to the amount of wear that is experienced and/or number of print cycles employed. When the electrical resistance of the used PCR rises to an unacceptably high level, its performance degradation is manifested in image print quality flaws. Specifically, the image print quality begins to show unwanted black areas, commonly referred to as "background". Continued increase in the thin film's electrical resistance will cause more print quality defects to appear on the photocopies, such as undesirable, residual, unerased previously printed images (commonly called "electrostatic-ghosting"). Once print quality defects appear, therefore, the conventional practice is simply to discard the used, spent and/or physically degraded PCR and replace it with a fresh OEM-supplied PCR.

It would therefore be highly desirable if such used, spent and/or physically degraded PCR's could be "rejuvenated" so as to conserve component parts and reduce the costs associate with maintaining high print quality of an electrostatographic imaging machine. It is towards fulfilling such a need that the present invention is directed.

Broadly, the present invention is embodied in a used, spent or physically degraded PCR which has been rejuvenated to an extent that it matches (or exceeds) the print quality and service life of an OEM-supplied PCR. More specifically, according to the present invention, a used PCR is treated so as to apply an overcoating of a dispersion comprised of an electrically conductive particulate material, such as graphite or carbon black, and a polymeric binder (e.g., polyurethane latex). The electrically conductive material imparts the necessary electrical properties to the PCR for purposes of "rejuvenation", while the presence of the polymeric binder serves to impart long-term service life to the PCR and also permits the use of less electrically conductive material.

These and other aspects and advantages of the invention will become more clear after careful consideration is given to the following detailed description of the preferred exemplary embodiments.

DETAILED DESCRIPTION OF THE PREFERRED EXEMPLARY EMBODIMENTS

The reconditioned PCR's according to this invention will most preferably have an overcoating which is the dried residue of a homogenous dispersion of electrically conductive particles and a polymeric binder. Alternatively, the overcoating may be in the form electrically conductive particles directly applied in dry form as an overcoating onto the worn and/or spent PCR surface.

Virtually any electrically conductive particles may be employed in the practice of this invention. When applied in the form of a dispersion, the conductive particles are most preferably alcohol suspensions of graphite having between about 1% to about 20% solids content. Most preferably, graphite suspensions having a higher content solids (e.g., between about 15% to about 20% solids) are preferred as they translate into longer PCR service life. A particularly preferred graphite suspension is commercially available from Acheson Colloids Company, under the trade names "DAG 154" and "DAG 154 RFU". The latter graphite suspension is a ready-to-use formulation of the former and is pre-diluted with anhydrous isopropyl alcohol to adjust the solids content from about 20% to between about 3.0 to about 3.5%. Another commercially available graphite dispersion that may be employed in the practice of this invention is GRAPHOKOTE 220 PLUS III TRI-FREE that may be obtained from The graphite & Lubricant Division of Dixon Ticonderoga Co. or Lakehurst, N.J.

Particulate carbon black materials can also be used in the practice of this invention, particularly if applied to the PCR roller surface in a dry 100% solids form. A preferred carbon black has generally spherical particles with an average particle diameter of between about 15 to about 95 nm, more preferably between about 20 to about 30 nm, most preferably about 23 nm. One particularly preferred carbon black that can be used successfully in the practice of this invention is commercially available from Cabot Corporation (CAS No. 1333-86-4).

Virtually any polymeric binder resin may be employed in the practice of this invention provided it is compatible with the electrically conductive materials and does not adversely affect the desired electrical properties of the overcoating. Preferably, the polymeric binder is a polyurethane provided as an aqueous dispersion in 1-methyl-2-pyrrolidinone and other solvents, such as alcohols (e.g., 2,2-dimethyl-1,3-propanediol, 1,6-hexanediol) and cyclohexanes (e.g., 5,-amino-1,3,3-trimethylcyclohexanemethanamine and 5-isocyanato-1-(isocyanatomethyl)-1, 3,3-trimethylcyclohexane). One particularly preferred polyurethane dispersion that may be employed in the practice of this invention is WITCOBOND W-240, commercially available from Witco Chemicals, Inc. of Houston, Tex.

The electrically conductive liquid dispersion may be applied as an overcoating onto the surface of the PCR in any convenient manner. Thus, for example, the electrically conductive liquid dispersion may be applied by dipping, padding or spraying. Preferably, the used or spent PCR is physically dipped into a vat of the electrically conductive liquid dispersion for a time sufficient to form an overcoating of the surface which is less than about 0.5 mil thick.

The liquid dispersion is thereafter dried (preferably in air) so as to allow evaporation of all aqueous and organic solvents. The resulting dried residue coating on the PCR surface will therefore typically contain between about 1.0 to about 10.0 wt. %, more preferably about 1.9 wt. % of the electrically conductive particles based on the total weight of the dried residue coating. If used, the polymeric binder (e.g., polyurethane) will be present in the dried residue in an amount less than about 15.0 wt. %, preferably about 5.0 wt. %, based on the total dried residue coating weight. Since the electrically conductive particles and polymeric binder are applied as a liquid dispersion, each of the components will be homogeneously mixed and dispersed with one another throughout the thickness of the dried residue coating.

Further understanding of this invention will be obtained from the following non-limiting Example.

EXAMPLE

I. Dispersion Formulation Preparation 135 ml of Acheson's DAG 154 graphite was placed in a 1500 ml beaker and mixed under vigorous mechanical agitation with 1050 ml of isopropanol. 100 ml of WITCOBOND W-240 polyurethane latex was then added to the graphite/isopropanol mixture while continuing the vigorous mechanical stirring.

II. PCR Coating

Used PCR's were obtained from commercially available electrostatographic printers (Hewlet Packard Model Nos. III si and 4si) and cleaned with isopropanol. The mechanical stirring of the dispersion was stopped, and the PCR submerged in the 1500 ml beaker at a rate of about 5 inches per minute. Following complete submersion, the PCR was withdrawn from the 1500 ml beaker at a rate of about 5 inches per minute. Mechanical stirring of the dispersion was again started. The PCR was allowed to dry at room temperature for about 1 hour.

III. Operational Test Procedures and Results

The reconditioned PCR's obtained in Section II above were replaced in service in their respective electrostatographic printer (Hewlet Packard Model Nos. III si and 4si) and examined for print quality during 16,000 print cycles using a standard print pattern. As compared to the untreated (used) PCR's, the reconditioned PCR's in accordance with this invention showed much higher image densities, for example about 1.35 and greater for 1 cm×1 cm black squares, and had comparable print resolution to OEM-supplied PCR's with no background print and OEM levels of "blasting" or "fog". All of the resulting prints obtained from the rejuvenated PCR's were therefore judged to be of high quality comparable to the OEM-supplied PCR's.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A reconditioned primary charge roller for an electrostatographic imager comprising an axle, an electrically conductive cylindrical foam roller surrounding said axle, and a coating on said foam roller formed of 100% solids of electrically conductive carbon black particles.

2. A used primary charge roller for an electrostatographic imager reconditioned by forming a coating on an exterior surface of a used primary charge roller with an amount of electrically conductive particles sufficient to produce print qualities comparable to an original equipment manufacturer-supplied primary charge roller, wherein said coating is 100% solids of carbon black particles.

* * * * *